United States Patent [19]

Wilkinson et al.

[11] 4,100,982

[45] Jul. 18, 1978

[54] DRILL CUTTINGS SEPARATION AND CONTROL APPARATUS

[75] Inventors: Brendan Michael Wilkinson, Salem; Erasmo Belfiore, Roanoke, both of Va.

[73] Assignee: Gardner-Denver Company, Dallas, Tex.

[21] Appl. No.: 794,273

[22] Filed: May 5, 1977

[51] Int. Cl.[2] ..... E21B 21/00

[52] U.S. Cl. ..... 175/206; 55/385 R

[58] Field of Search ..... 175/206, 209, 213, 210, 175/211, 66; 55/385 R, 385 D, 463, 467

[56] References Cited

U.S. PATENT DOCUMENTS

| | | | |
|---|---|---|---|
| 751,253 | 2/1904 | Brady | 175/209 |
| 2,107,552 | 2/1938 | Smith | 175/209 |
| 2,144,586 | 1/1939 | Kelley | 175/209 X |
| 2,145,939 | 2/1939 | Markley | 175/209 |
| 2,590,958 | 4/1952 | Goodrich | 175/209 |
| 3,800,890 | 4/1974 | Gyongyosi | 175/209 |

*Primary Examiner*—Ernest R. Purser
*Assistant Examiner*—Richard E. Favreau
*Attorney, Agent, or Firm*—Michael E. Martin

[57] ABSTRACT

A drill cuttings and dust control hood formed as an inverted rectangular box having depending flexible skirts on three lateral sides and a swinging door formed on a fourth side of the box for drill cuttings removal. The dust control hood includes a conical drill cuttings deflector disposed around the drill stem and directly above the drill hole. The conical deflector includes a plurality of apertures disposed around its base and above a transverse baffle plate. A source of air suction is connected to a tangential outlet opening through the deck of the hood into the interior of the space formed within the conical deflector. Flexible collars on the hood deck and the apex of the conical deflector form dust seals around the drill stem.

8 Claims, 2 Drawing Figures

DRILL CUTTINGS SEPARATION AND CONTROL APPARATUS

BACKGROUND OF THE INVENTION

Rock drilling by percussion and rotary drilling techniques produces cuttings in the hole formation process which comprise fine dust particles as well as larger rock chips and fragments. It is necessary and desirable to control the drill cuttings, which are normally conveyed from the drill hole by a high velocity air stream, to protect the work environment from unwanted pollution and prevent damage to the drilling equipment and components of the drill cuttings control apparatus.

Examples of prior art drill cuttings control apparatus are disclosed in U.S. Pat. Nos. 3,070,180 to R. F. Norrick and 3,800,890 to L. Gyongyosi et al. The present invention represents improvements in drill cuttings control apparatus over prior art devices in accordance with the advantages and superior features discussed hereinbelow.

SUMMARY OF THE INVENTION

The present invention provides an improved drill cuttings separaion and control apparatus for rock drills and the like wherein pollution of the operating environment of the drill due to air-borne dust and rock chips is minimized and the drill apparatus is protected from damage by relatively large cuttings or rock fragments.

The present invention also provides a drill cuttings control apparatus which provides for improved separation of the air-borne dust from larger particles or fragments as the drill cuttings emanate from the drill hole whereby the heavier drill cuttings are confined by the cuttings control apparatus and are prevented from clogging and damaging the apparatus or from falling back into the drill hole.

The present invention further provides a drill cuttings control apparatus in which air-borne dust is withdrawn from an enclosure over the drill hole in an improved manner providing for additional separation of heavier dust particles from the fluid stream to reduce dust loadings on the dust filters and the like.

The present invention still further provides for an improved drill cuttings separation and control apparatus which includes a hood adapted to be disposed over a drill hole, said hood including improved structure for collecting and separating the drill cuttings ejected from the drill hole by the cuttings evacuation medium. The hood is further constructed to facilitate movement of the cuttings control apparatus laterally away from the hole with the drill rig in the event that a drill stem is left in the hole.

The advantages and superior features of the drill cuttings separation and control apparatus of the present invention may be further appreciated from the following detailed description.

DESCRIPTION OF THE PREFERRED EMBODIMENT

Figure 1:
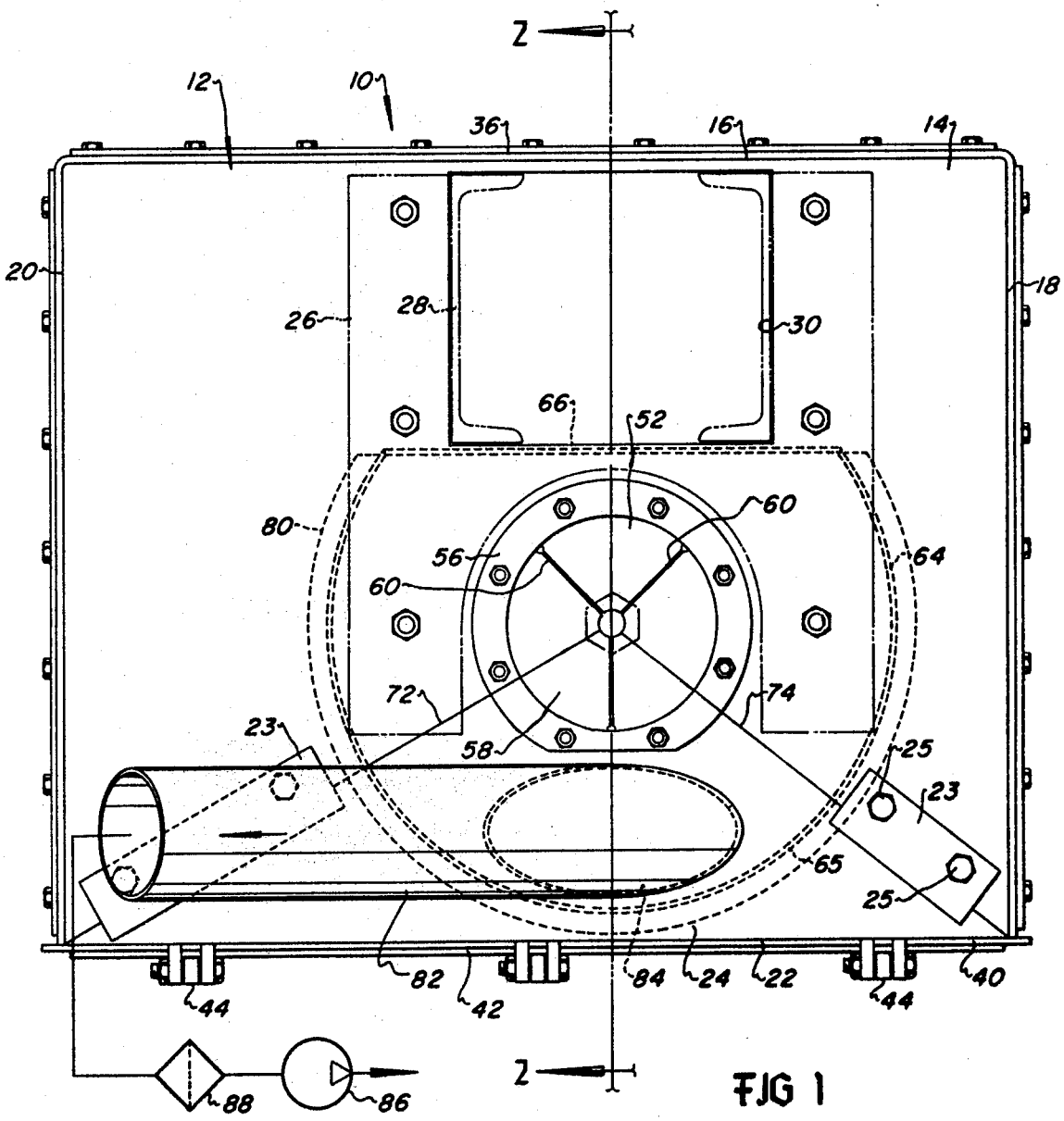
FIG. 1 is a plan view of a drill cuttings separation and control apparatus according to the present invention; and, FIG. 2 is a side elevation taken in section along the line 2—2 of FIG. 1.
Figure 2:
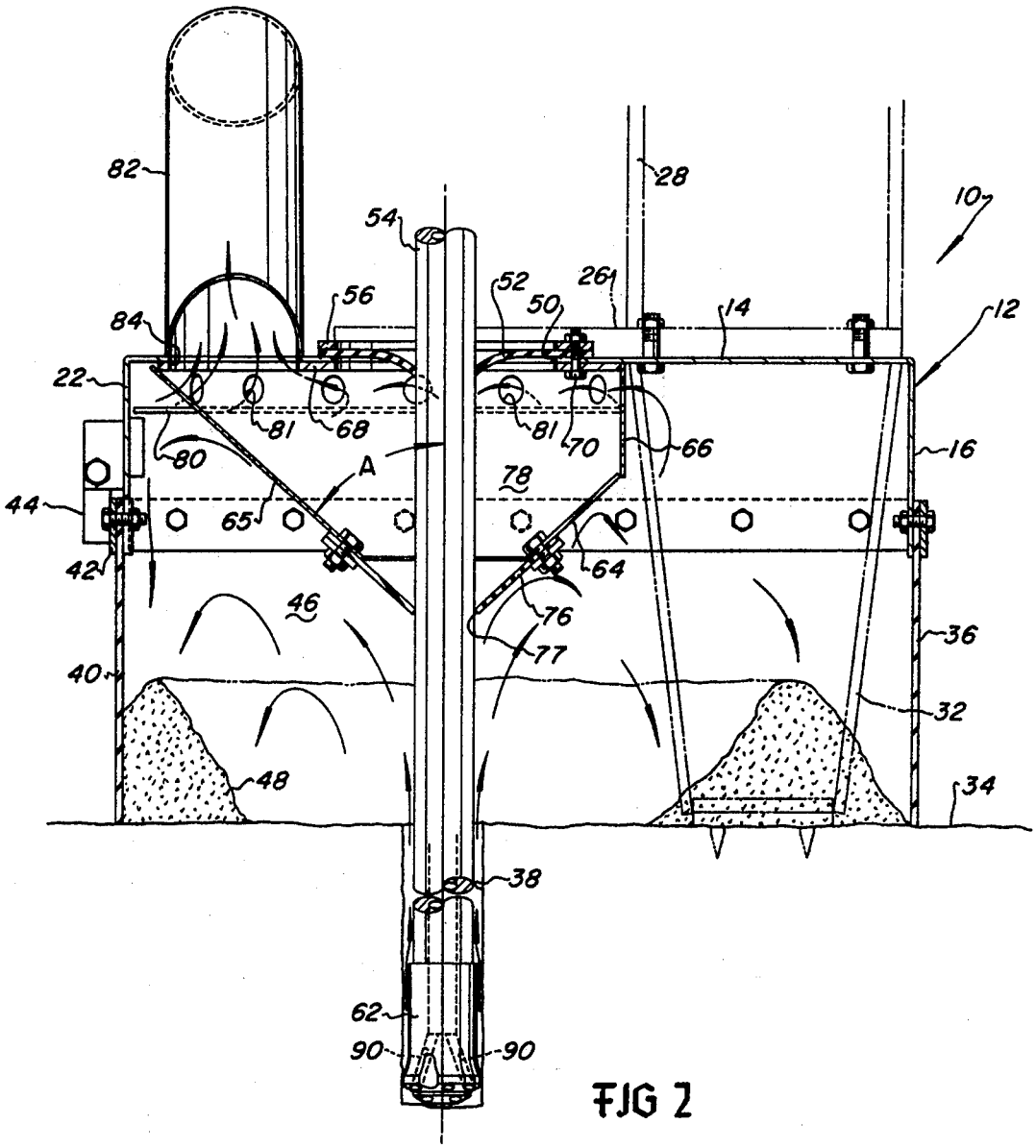

Referring to the drawings, the drill cuttings separation and control apparatus of the present invention is generally designated by the numeral 10. The apparatus 10 is adapted to be used with portable drilling rigs of the percussion or rotary type wherein the drill hole is formed by localized crushing of the rock by impact and forcible penetration of the rock structure. The rock cuttings, namely small chips, fragments, and finer particles called dust are normally evacuated from the hole by a continuous stream of pressure air which is conducted down to the bottom of the hole within the hollow drill stem and is ejected through nozzles or passages in the drill bit. In the drawing FIGS. 1 and 2 the apparatus 10 comprises a hood 12 formed as an inverted rectangular metal box having a deck 14 and depending side walls 16, 18, and 20. A portion of the hood 12 comprising a fourth side wall 22 and a portion of the deck 24 may be separated from the remainder of the hood and is retained in assembly therewith by suitable brackets 23 and fasteners 25. The hood 12 is adapted to be removably fastened to a flange 26 fixed to the lower end of a drill mast or tower 28. The hood 12 is adapted to have a suitable opening 30 in the deck 14 to permit the mast foot 32 to project through the deck into engagement with the ground surface 34 as shown in FIG. 2. The hood 14 is further characterized by sidewall portions formed by a depending flexible skirt 36 which is removably fastened to the sidewalls 16, 18, and 20 and is intended to engage the ground surface to form an enclosure around a drill hole 38. A skirt portion 40 also depends from the sidewall 22 into engagement with the ground surface 34. The skirt portion 40 is mounted on a suitable bracket 42 which is attached to the sidewall 22 by hinges 44. The skirt portion 40 may, accordingly, be swung upward to gain access to the enclosed space 46 formed by the hood 12 for removal of drill cuttings 48 which accumulate on the ground surface 34 around the drill hole. The skirt portions 36 and 40 are preferably made of a durable flexible rubberlike material.

The deck 14 includes a circular opening 50 in which is disposed a flexible seal 52 made of rubber or the like. The seal 52 is adapted to surround and engage a drill stem 54, FIG. 2, to substantially prevent air and dust from exiting or entering the enclosed space within the hood 12 through the deck opening 50. The seal 52 is retained on the deck 14 by an annular collar 56. The seal 52 includes a circular segment 58 which is fastened to the deck portion 24. Further radial slits 60 are formed in the seal 52 to permit entry and withdrawal of a drill bit 62 attached to the distal end of the drill stem 54.

The apparatus 10 is further characterized by a substantially conically shaped cuttings deflector 64 which depends from the deck 14 and has its central axis substantially coaxial with the longitudinal central axis of the drill stem 54. The deflector 64 is formed with a planar surface portion 66 to provide clearance for the mast foot 32. The deflector 64 includes a base 68 which is suitably fastened to the deck by fasteners 70. The conical wall portion of the deflector 64 could be fixed directly to the underside of the deck 14, the last mentioned structure thereby also serving as the base. The deflector 64 includes a conical segment 65 formed between the parting lines 72 and 74 of the removable hood portion 24. The deflector 64 is further characterized by a detachable flexible seal 76 which has an opening coaxially aligned with the axis of the drill stem 54. The seal 76 may be made of a rubberlike material and the opening therein is proportioned to assure that the seal prevents drill cuttings from entering the space 78 defined by the interior of the deflector 64. The seal 76 may be provided with radially extending slits, as are provided for the seal 52, to facilitate entry and withdrawal of the drill bit through the seal. The angle A that the conical surface of the deflector forms with the drill stem axis, which is also the axis of revolution of the cone, is desirably formed to be in the range of 45 to 50 degrees to provide for optimum separation of larger drill cuttings from the finer particles that are ejected from the drill hole.

The deflector 64 still further includes an annular baffle 80 fixed to the exterior of the conical surface of the deflector and spaced from and substantially parallel to the deck 14. The baffle 80 extends around the conical surface of the deflector 64, and includes a portion which may be moved with the deflector segment attached to the hood segment 24. The baffle 80 does not extend along the planar surface 66 in the embodiment shown in the drawings so as to provide clearance for the mast foot 32. The mast foot 32 itself serves as a baffle to some extent. The deflector 64 is provided with a series of apertures 81 disposed spaced apart around the deflector between the baffle 80 and the base 68 which apertures serve to permit the flow of air and whatever drill cuttings are borne therewith from the enclosed space 46 into the space 78. The apparatus 10 is further characterized by a conduit 82 which projects upward from the deck 14 and is disposed around an opening 84 through the deck into the space 78. The opening 84 is disposed adjacent to the outer periphery of the deflector 64. The conduit 82 is adapted to be connected to a source of suction for evacuating the air in the enclosed spaces 46 and 78 formed within the envelope of the hood. The source of suction may comprise a vacuum pump 86. Suitable filtering means 88 for collecting dust and the like may be interposed between the pump 86 and the opening 84.

In the operation of the apparatus 10 pressure air is substantially continuously pumped down through the hollow drill stem 54 and out through passages 90 in the bit 62. The drill cuttings formed by the bit are conveyed up through the annulus formed between the drill stem 54 and the sidewall of the hole 38 at relatively high velocity and are ejected into the enclosed space 46. A substantial portion of the drill cuttings ejected from the hole 38, in the form of rock chips and fragments, impinge against the deflector 64 and fall to the surface 34, or said cuttings merely fall to the surface under the hood 12 as the air velocity decreases upon entry into the enclosed space 46. The conical deflector 64 including the baffle 80 directs the impinging drill cuttings against the sidewalls of the hood 12 whereby they fall to the ground surface and accumulate until periodically removed through the opening provided by the hinged skirt 40.

The aforementioned source of suction applied to the conduit 82 is normally maintained to be sufficient to reduce the air pressure within the enclosure below the ambient atmospheric pressure surrounding the apparatus 10. Accordingly, there is little tendency for drill cuttings to escape from the apparatus around the seal 52 or the skirts 36 and 40. In fact, air tends to flow into the enclosure formed by the hood 12 from leakage around the seal 52 and the skirts. Moreover, the tortuous change in direction of air flowing around the baffle 80 and through the apertures 81 causes further inertial separation of air-borne drill cuttings. Air sucked through the apertures 81 is believed to be induced to flow in a substantially vortical path until it exits through the conduit 82. In like manner air leaking into the space 78 from the space 46 through the clearance and slits in the seal 76 is also believed to be induced to flow in a vortical manner within the space 78. Such a flow path of the air and remaining air-borne particles of drill cuttings tends to further separate many of the particles whereby they impinge on the interior surface of the deflector 64.

Periodic removal of the drill stem from the hole for bit changing or inspection or when drilling is finished allows the drill cuttings which have collected in the interior of the deflector 64 to be dumped through the seal opening 77. The drill rig would normally be moved off of the hole before dumping the cuttings but in any event the volume of cuttings would not be substantial. If it is desired to move the mast 28 and apparatus 10 away from the hole 38 with a section of drill stem still disposed in the hole, the segment 24 of the hood 12 may be first removed to permit lateral movement of the apparatus.

What is claimed is:

1. A drill cuttings separation and control apparatus for use with a rock drill rig wherein drill cuttings are forcibly ejected from the drill hole by pressure air, said apparatus comprising:

a hood including a transverse deck and depending sidewalls engageable with the ground surface to form a first substantially enclosed space around a drill hole;

an opening in said deck for admitting a drill stem into said drill hole;

flexible sealing means disposed in said opening and around said drill stem;

a drill cuttings deflector disposed within said first enclosed space and characterized by a conical wall portion disposed around and spaced from said drill stem, and a base contiguous with said deck, said conical wall portion depending from said base toward said drill hole;

said deflector defining in part a second enclosed space;

aperture means formed in said deflector for admitting air and air-borne drill cuttings from said first enclosed space to said second enclosed space; and, an opening into said second enclosed space and in communication with means for evacuating air and air-borne drill cuttings from said first enclosed space and said second enclosed space.

2. The invention set forth in claim 1 wherein:

said conical wall portion includes a flexible seal member disposed to be engageable with said drill stem.

3. The invention set forth in claim 1 wherein:

said sidewalls include a hinged portion adapted to be swung open for removal of drill cuttings accumulated within said first enclosed space.

4. The invention set forth in claim 1 wherein:

said sidewalls include a flexible skirt portion for engagement with the ground surface adjacent to said drill hole.

5. The invention set forth in claim 1 wherein:

said apparatus comprises a removable segment of said hood and said deflector whereby said hood may be moved laterally away from a drill stem disposed in said drill hole.

6. The invention set forth in claim 1 wherein:

said aperture means comprise a plurality of apertures spaced around said conical wall portion adjacent the base of said deflector.

7. The invention set forth in claim 6 wherein:

said opening into said second enclosed space is disposed in said deck near the periphery of said base.

8. The invention set forth in claim 6 together with:

a baffle comprising an annular plate disposed around said conical wall portion and spaced from said base whereby said apertures are between said baffle and said base.

* * * * *